US007762834B2

(12) United States Patent
Schrader

(10) Patent No.: US 7,762,834 B2
(45) Date of Patent: Jul. 27, 2010

(54) PLUGGABLE CONDUCTOR TERMINAL

(75) Inventor: Andreas Schrader, Delbrück (DE)

(73) Assignee: Phoenix Contact GmbH & Co. KG (DE)

( * ) Notice: Subject to any disclaimer, the term of this patent is extended or adjusted under 35 U.S.C. 154(b) by 0 days.

(21) Appl. No.: 12/180,908

(22) Filed: Jul. 28, 2008

(65) Prior Publication Data

US 2009/0035998 A1 Feb. 5, 2009

(30) Foreign Application Priority Data

Jul. 31, 2007 (DE) ..... 10 2007 036 295

(51) Int. Cl.
*H01R 4/24* (2006.01)

(52) U.S. Cl. ..... 439/441; 439/835

(58) Field of Classification Search ..... 439/441, 439/834–836, 709, 436–437
See application file for complete search history.

(56) References Cited

U.S. PATENT DOCUMENTS 5,915,991 A * 6/1999 Roman ..... 439/441
6,109,952 A * 8/2000 Jaag ..... 439/441
6,336,824 B1 * 1/2002 Sorig ..... 439/441
6,682,364 B2 * 1/2004 Cisey ..... 439/441
6,851,967 B2 * 2/2005 Miyoshi et al. ..... 439/441
7,004,781 B2 * 2/2006 Walter ..... 439/441
7,083,463 B2 * 8/2006 Steinkemper et al. ..... 439/441
7,329,143 B2 * 2/2008 Schrader ..... 439/441

* cited by examiner

*Primary Examiner*—Xuong M Chung-Trans
(74) *Attorney, Agent, or Firm*—Bourque & Associates

(57) ABSTRACT

A pluggable conductor terminal includes a plug connector (6) with a pin guide (8) emptying into a contact space (5) and a conductor guide channel (24) with a conductor connection aperture (25) that is transformed into a central clamping space (19) in the clamp housing. The conductor guide channel (24) is inclined toward the pin guide (8). A contact piece (3) with a contact part (4) for the contact pin (7) is mounted in the contact space (5) with a clamp spring (15) for the conductor (33) in the clamping space (19). For the sake of simpler manufacture, the contact piece (3) and the clamp spring (15) are of one piece, and consist of an elongated, flat band (2) bent exclusively crosswise to its longitudinal dimension.

10 Claims, 3 Drawing Sheets

PLUGGABLE CONDUCTOR TERMINAL

TECHNICAL FIELD

The invention relates to a pluggable conductor terminal with an insulating housing and more particularly, to a conductor terminal for connecting a conductor with a pin on a printed circuit board, and wherein the terminal includes a one piece contact spring particularly bent and arranged within the insulating housing.

BACKGROUND INFORMATION

In conventional models, such pluggable conductor terminals include a contact piece for which the contact part of the contact pin to be contacted and the clamp spring with a clamp point for the conductor to be connected consist of two or more parts that are joined together by means of welding or soldering. In the course of the miniaturization of such clamps whose disk-shaped insulating housings suited for row configuration include a width of magnitude of 3 mm, the contact parts and clamp springs possess correspondingly small dimensions, but must meet high requirements for positive function. Therefore, the weld or solder connection of the current- or voltage-conducting contact piece is performed with great precision, which is realizable only at high expense.

SUMMARY

It is the task of the invention to provide a conductor terminal of the type mentioned at the outset whose contact part is simpler to produce.

It is essential to the invention that the contact piece and the clamp spring consist of a single part, namely a flat band bent exclusively crosswise to its longitudinal dimension. The peculiarity of the torsion spring is that it comes into contact with the connected conductor only by means of its clamp leg that is tensioned by the clamp leg against the clamp abutment formed by the insulating housing. The more or less point- or line-shaped contact point between the clamp leg and the clamped conductor is then adequate in any case if only low amounts of current flow through the metallic flat band.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
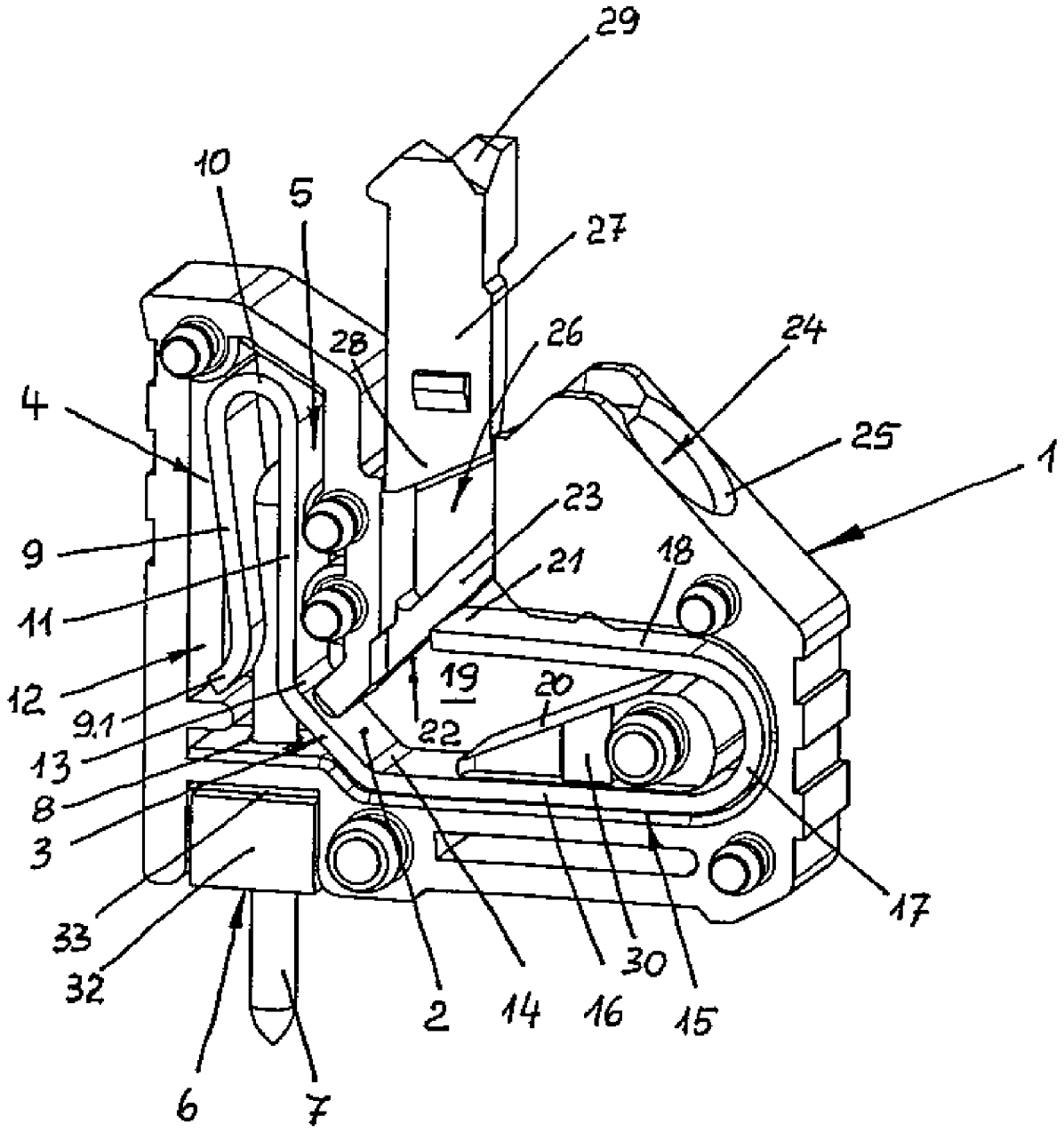
FIG. 1 is a perspective view of a spring-force print terminal seen from the open side of the insulating housing.

In particular, FIG. 1 shows an insulating housing 1 that is implemented as a narrow, disk-shaped housing suited for row configuration. In practical implementation, the housing 1 possesses a width of from 2.5~3.5 mm. A current-conducting contact piece 3 is mounted within the housing 1 and includes two spatially-separated contact points, as will be explained in the following. The contact piece 3 consists of a flat, metallic band 2 bent exclusively crosswise to its longitudinal dimension. A flat band 2 is involved that possesses a constant width along its entire length.

Figure 3:
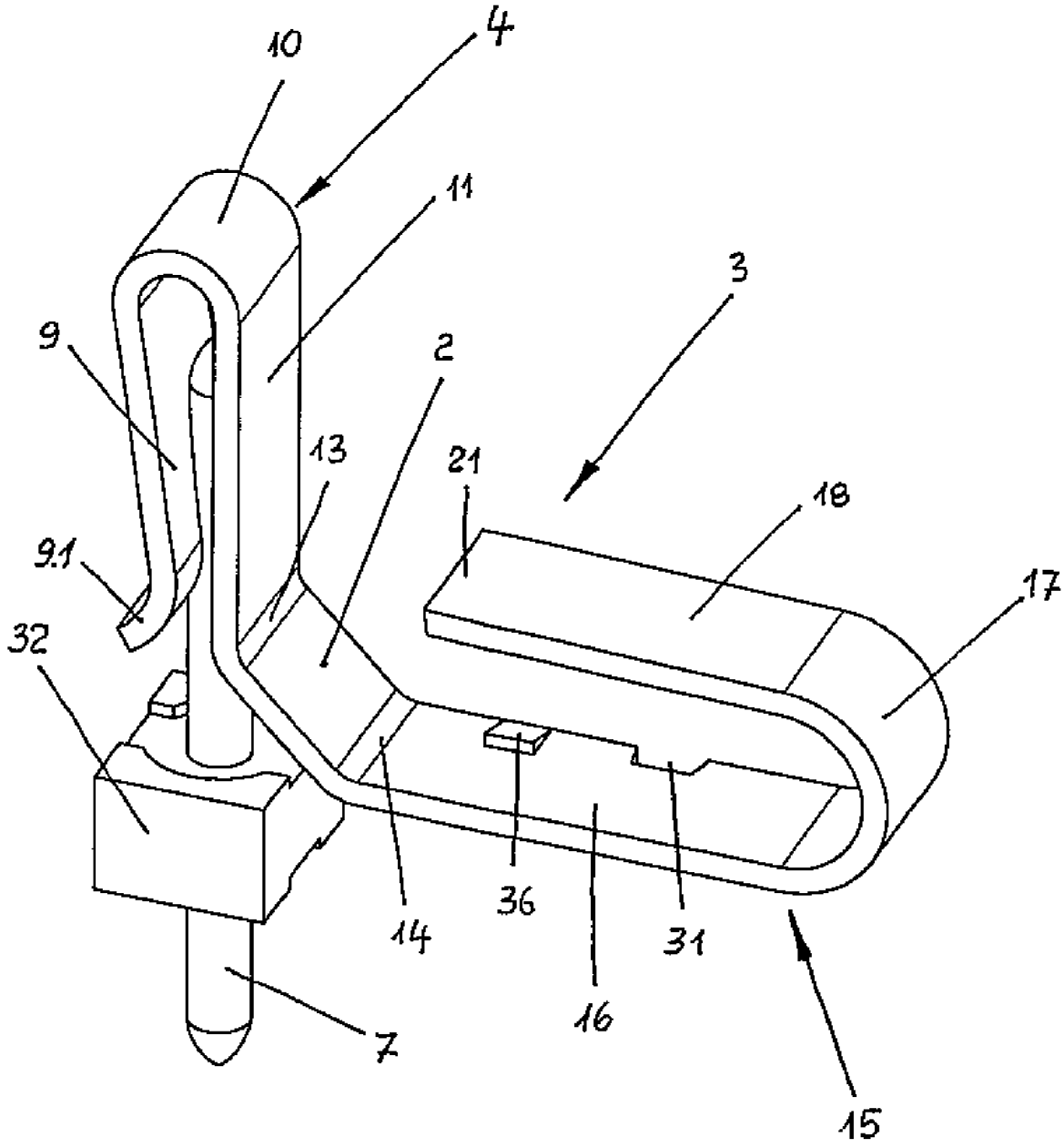
FIG. 3 is a perspective view of the bent flat band forming the contact piece and the clamp spring along with a contact pin.

First, a spring tulip 4 is shaped from a flat, metallic band 2 that is positioned within a contact space 5 of the insulating housing 1. The spring tulip 4 is the contact element for a plug connector 6 in the floor or bottom region of the insulating housing 1, by means of which the conductor terminal may be stacked onto a contact pin 7. Such a contact pin 7, as seen in FIG. 3, is firmly mounted on a circuit board (not shown) and is provided with a plastic block 32 by means of which it is supported on the circuit board. In plugged condition, the plastic block 32 is located within a receiver space 33 that is located in the vicinity of floor-mounted plug connector 6 of the insulating housing 1, and that is open toward its lower side. A pin guide 8 is adjacent to the receiver space that consists of a cylindrical penetrating aperture that connects together the receiver space 33 and the contact space 5 and serves for the passage of the contact pin 7.

The contact space 5 is an elongated space extending along the plug direction of the contact pin 7. This corresponds to the elongated shape of the spring tulip 4 that first consists of a spring leg 9 formed from one of the two ends of the flat band 2. The spring leg 9 passes over a flexible joint with an arc of more than 180° and is transformed into a support leg 11 that rests against an inner wall of the insulating housing 1. Therefore, when the contact pin 7 is inserted, only the spring leg 9 of the spring tulip 4 can expand, for which free space 12 is provided within the contact space 5 into which the spring leg 9 of the spring tulip 4 may expand. Insertion of the contact pin 7 into the spring tulip 4 is simplified by means of an end 9.1 of the spring leg 9 bent away from the supporting leg 11. The flexible joint 10 of the spring tulip 4 offset from the pin guide 8 toward which the spring tulip 4 opens upon insertion of the contact pin 7. The supporting leg 11 of the spring tulip 4 extends along a straight direction parallel to the contact pin 7, and the inner side of the supporting leg 11 of the spring tulip 4 lies tangential to the pin guide 8.

As FIGS. 1 and 3 further show, the metallic flat band 2 includes bends 13 and 14 each at an angle of approximately 135°, over which the supporting leg 11 is transformed into a bearing leg 16, which is a part of a torsion spring 15 formed from the flat band 2. Thus, the bearing leg 16 of the torsion spring 15 is perpendicular to the supporting leg 11 of the spring tulip 4, which is however, not absolutely required. A clamp leg 18 is connected to the flexor 17, which in turn is connected to the bearing leg 16 of the torsion spring 15. In the non-clamping initial position, the flexor 17 possesses a 180° arc, and is correspondingly parallel to the clamp leg 18 bent back into a bearing leg 16.

The section of the flat band 2 forming the torsion spring 15 is mounted within a clamping space 19 of the insulating housing 1, whereby the side of the bearing leg 16 facing away from the clamp leg 18 is supported by the entire surface of a wall of the clamping space 19 facing toward the bottom side of the insulating housing 1. A wedge-shaped strike surface 20 is located within the clamping space 19 with its upper side angled toward the non-jointed clamp leg 18. The clamp leg 18 strikes against this upper side upon depression so that the torsion spring 15 is not over-extended.

Figure 2:
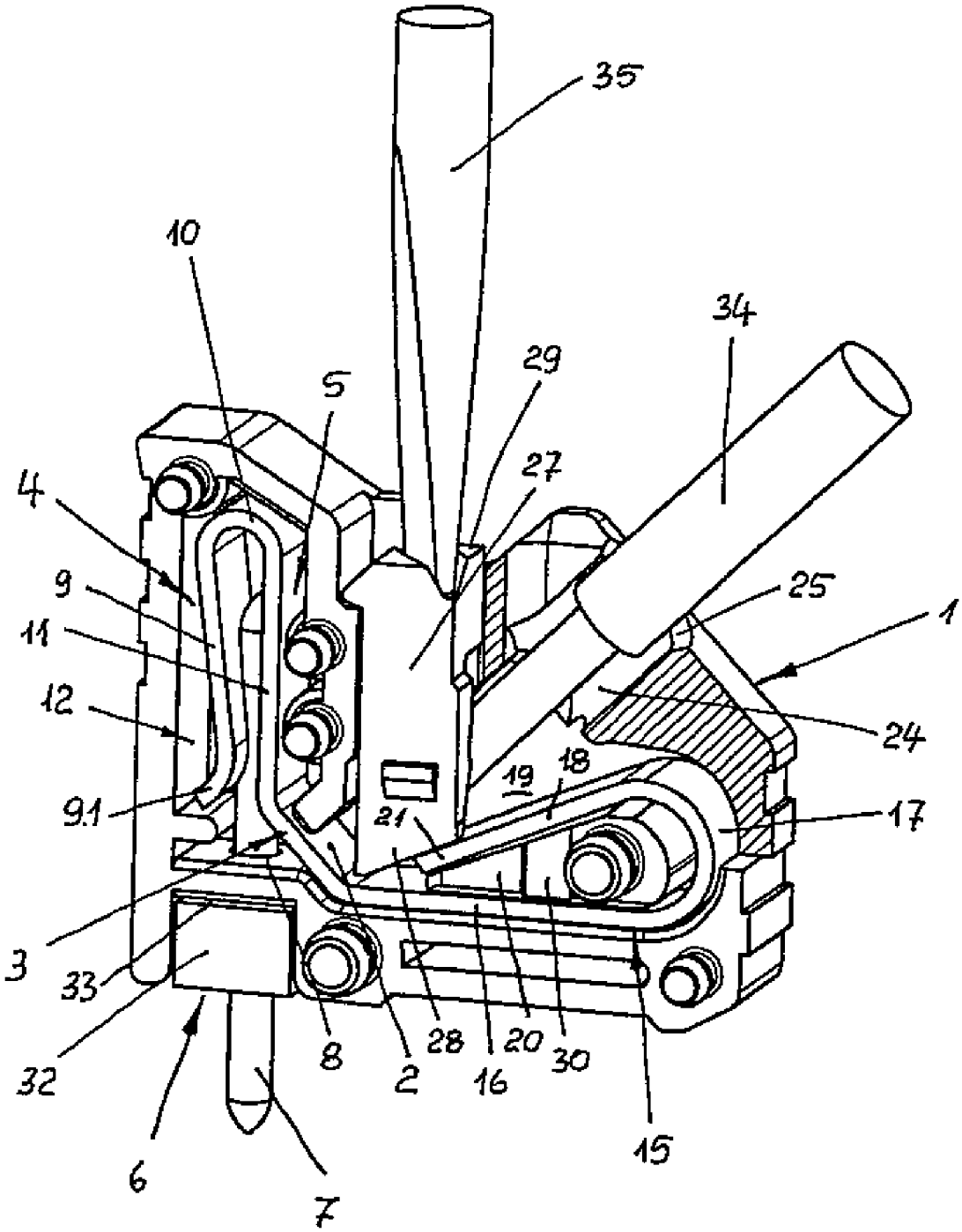
FIG. 2 is a perspective view of the print terminal of FIG. 1 during clamping or releasing a conductor.

The second end of the flat band 2 forms a clamp end 21 at the clamp leg 18 that interacts with a clamp abutment 22. The clamp abutment 22 is formed by a clamping rib 23 of the insulating housing 1 projecting into the clamping space 19. The clamp abutment 22 of this clamping rib 23 extends at an angle of 45° to the plug direction of the contact pin 7. A conductor-guide channel 24 leads to the clamp abutment 22 at the same angle within the insulating housing 1, as FIG. 2 particularly shows. A conductor-connection aperture 25 is provided on the upper side of the insulating housing 1 that transforms into the conductor-connection channel. FIG. 2 shows its clamping direction oblique to the plug direction of the contact pin 7 using the conductor 34 shown there.

A guide channel 26 is formed into the insulating housing 1 between the conductor-guide channel 24 and the contact space 5 that receives the spring tulip 4. This guide channel 26 extends parallel to the plug direction of the contact pin 7. A pusher 27 is mounted within the guide channel 26 so that it may be displaced. The inner end 28 is designed to be narrow enough that, as FIG. 2 shows, it loads the clamp end 21 on the clamp leg 18 of the torsion spring 15 against the clamp rib 23 in the pressed-in position of the pusher 27. This is possible because the clamp rib 23 covers the clamp end 21 of the clamp leg 18 merely partially, preferably more than half.

As FIG. 2 shows, the pusher 27 includes an actuation end 29 suited to the insertion of a tool blade 35. Another peculiarity of the pusher is the fact that, in its initial (non-actuated) position shown in FIG. 1, it is injection-molded to the insulating housing 1. The connecting spars still existing are implemented as intended break points that are first separated upon first actuation of the pusher 27. The pusher 27 is simultaneously engaged into its position resting against the clamp end 21 of the clamp leg 18, which occurs at the blocked adjacent housing in the open implementation of the insulating housing 1.

Finally, FIG. 3 shows a recess 31 and also an engaging notch 36 that serve to secure the contact piece 3 formed of the flat band 2 in the insulating housing 1. For this, one may see a positioning rib 30 in FIG. 1 that projects into the clamping space 19 and engages with a friction fit into the recess 31 on the bearing leg 16 of the torsion spring 15.

Modifications and substitutions by one of ordinary skill in the art are considered to be within the scope of the present invention, which is not to be limited except by the allowed claims and their legal equivalents.

The invention claimed is:

1. A conductor terminal comprising:

an insulating housing (1) including a floor-mounted plug connector region (6) that is configured to allow the conductor terminal to plug onto a contact pin (7);

a contact pin guide (8) in the insulating housing (1) that opens into a contact space (5); and a current conducting contact piece (3) located within the insulating housing (1) and made of a single piece of current-conducting material, the current conducting contact piece comprising:

a spring tulip portion (4) located within the contact space (5) and at least partially surrounding the contact pin (7);

a first crosswise bend (13) connected to the spring tulip portion (4), wherein the first crosswise bend is further connected to a flat metallic band region (2), and wherein the flat metallic band region (2) is further connected to a second crosswise bend (14); and a torsion spring portion (15) located within a clamping space (19), that terminates in a clamp end portion (21), said clamp end portion (21) configured for making electrical contact with a conductor (34), wherein said torsion spring portion is essentially perpendicular to said spring tulip portion.

2. The conductor terminal of claim 1 further comprising a conductor-connection aperture (25) located along an upper-side of the insulating housing (1), the conductor-connection aperture (25) including conductor guide channel (24) that opens into the clamping space (19).

3. The conductor terminal of claim 1, wherein the spring tulip portion (4) comprises a spring leg (9) connected to a flexible joint (10) that is further connected to a support leg (11), wherein the support leg (11) is firmly mounted within the contact space (5).

4. The conductor terminal of claim 1, wherein the torsion spring portion (15) comprises a bearing leg portion (16) that is connected between the second crosswise bend (14) and a flexor portion (17) that forms a 180 degree curve, wherein the flexor portion (17) is also connected to a clamp leg portion (18).

5. The conductor terminal of claim 4, further comprising a clamp rib (23) formed in the insulating housing (1), wherein the clamp log portion (18) is tensioned against a connected conductor (34) that is inserted into the conductor guide channel (24) through the conducter-connection aperture (25), and wherein the clamp end portion (21) of the clamp leg portion (18) comes into electrical contact with a connected conductor (34) inserted into the conductor guide channel (24) through the conductor-connection aperture (25).

6. The conductor terminal of claim 5, further comprising:

a clamp abutment (22) formed by the interaction of the clamp leg portion (18) with the clamp rib (23), wherein the clamp rib (23) projects into the clamping space (19) that partially covers the clamp end portion (21); and a pusher (27) mounted within the insulated housing (1) is vertically displaced by an inner end (28) of the pusher (27) thereby displacing the clamp end portion (21) in the area not covered by the clamp rib (23).

7. The conductor terminal of claim 6, characterized in that the pusher (27) guided into a guide channel (26) adjacent to the contact space (5) in a direction parallel to the plug direction of the plug connector (6) and wherein the pusher (27) further comprises an actuation end (29) exposed on the upper side the insulated housing (1).

8. The conductor terminal of claim 4, characterized in that the bearing leg portion (16) of the torsion spring portion (15) is perpendicular to the supporting leg portion (11) of the spring tulip portion (4), whereby the clamp leg portion (18) of the torsion spring portion (15) in a non-clamping position is supported against the spring force of the torsion spring portion (15) in a position generally parallel to the bearing leg portion (16).

9. The conductor terminal of claim 4, further comprising:

a positioning rib (30) located within the clamping space (19) and between the bearing leg portion (16) and the clamping leg portion (18), wherein the positioning rib (30) contains a strike surface (20) designed to limit a deflection range of the clamp leg portion (18).

10. The conductor terminal of claim 4, characterized in that, the bearing leg portion (16) includes at least one recess (31), wherein the at least one recess is capable of engaging with the positioning rib (30).

* * * * *